US007766326B2

(12) United States Patent
Obuchi et al.

(10) Patent No.: US 7,766,326 B2
(45) **Date of Patent: *Aug. 3, 2010**

(54) SHEET CONVEYANCE APPARATUS, SHEET PROCESSING APPARATUS, AND IMAGE FORMING APPARATUS

(75) Inventors: Yusuke Obuchi, Abiko (JP); Hitoshi Kato, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/107,376

(22) Filed: Apr. 22, 2008

(65) Prior Publication Data

US 2008/0211177 A1 Sep. 4, 2008

Related U.S. Application Data

(63) Continuation of application No. 11/466,704, filed on Aug. 23, 2006, now Pat. No. 7,401,776.

(30) Foreign Application Priority Data

Aug. 31, 2005 (JP) ..... 2005-251423
Jun. 27, 2006 (JP) ..... 2006-176452

(51) Int. Cl.
*B65H 7/02* (2006.01)

(52) U.S. Cl. ..... 271/228; 271/272; 271/273

(58) Field of Classification Search ..... 271/81, 271/225, 184, 272, 265.01
See application file for complete search history.

(56) References Cited

U.S. PATENT DOCUMENTS 4,635,920 A 1/1987 Kodama ..... 271/81
6,135,446 A 10/2000 Thiemann et al. ..... 271/228
6,886,828 B2 5/2005 Saito ..... 271/225
7,185,883 B2 3/2007 Kato et al. ..... 270/58.11
7,192,020 B2 3/2007 Hayashi et al. ..... 270/58.11
7,401,776 B2 * 7/2008 Obuchi et al. ..... 271/228
2005/0082737 A1 4/2005 Sasaki et al. ..... 271/9.12
2005/0179190 A1 8/2005 Kamiya et al. ..... 270/58.07
2006/0076724 A1 4/2006 Obuchi et al. ..... 270/32
2006/0159499 A1 7/2006 Watanabe et al. ..... 399/391
2006/0220305 A1 10/2006 Serizawa et al. ..... 271/262

FOREIGN PATENT DOCUMENTS

JP 61-33459 2/1986
JP 2000-280554 10/2000

OTHER PUBLICATIONS

U.S. Appl. No. 11/741,860, filed Apr. 30, 2007.

* cited by examiner

*Primary Examiner*—Kaitlin S Joerger
(74) *Attorney, Agent, or Firm*—Fitzpatrick, Cella, Harper & Scinto

(57) ABSTRACT

The sheet conveyance apparatus includes a controller which controls a moving unit. The moving unit moves a sheet conveyance unit for conveying a sheet toward a direction intersecting with a sheet conveyance direction. The controller performs the control such that a moving speed of a shift moving unit is reduced when a shift amount of the sheet discharged from an image forming apparatus main body is small. Therefore, generation of a noise and vibration can be suppressed to save electric power consumption. When the shift amount of the sheet is large, the moving speed of the shift moving unit can be increased to shorten an operation time necessary to the movement.

6 Claims, 13 Drawing Sheets

SHEET CONVEYANCE APPARATUS, SHEET PROCESSING APPARATUS, AND IMAGE FORMING APPARATUS

This is a continuation of U.S. patent application Ser. No. 11/466,704, filed Aug. 23, 2006 now U.S. Pat. No. 7,401,776, allowed on Apr. 11, 2008.

BACKGROUND OF THE INVENTION

1. Field of the Invention

The present invention relates to an image forming apparatus such as a copying machine, a facsimile machine, a printer, and a multi function peripheral, a sheet conveyance apparatus which conveys an image-formed sheet (recording medium), and a sheet processing apparatus which performs processing to the sheet. Particularly the invention relates to the sheet processing apparatus, in which noises and vibration are suppressed, electric power consumption is saved, and productivity is improved by variably controlling a shift moving speed in a horizontal direction according to a shift amount when the sheets are automatically sorted.

2. Description of the Related Art

The sheet processing apparatus included in an image forming apparatus main body performs various kinds of processing. For example, the sheet processing apparatus bundles the plural image-formed sheets discharged from the image forming apparatus main body in each set, and the sheet processing apparatus performs saddle stitch processing to the bundled sheets. The sheet processing apparatus includes a sheet discharge tray which is moved in the horizontal direction parallel to a short side of the sheet while a sheet position is repeatedly shifted. In the sheet discharge tray (hereinafter referred to as shift movement), and the sheets or the processed sheet bundles are automatically sorted while stacked at the positions alternately offset in the horizontal direction.

However, when the shift movement of a large member such as the sheet discharge tray is alternately performed in the horizontal direction, the sheet processing apparatus is enlarged only by placing a drive mechanism of the sheet discharge tray, and the electric power consumption is also increased.

In order to solve the above problem, for example, Japanese Patent Application Laid-Open No. S61-033459 proposes the following sheet sorting device. In the sheet sorting device proposed in Japanese Patent Application Laid-Open No. S61-033459, a sheet-discharge rotating roller is rotated and the sheet is discharged to the sheet discharge tray by rotating frictional force of the sheet-discharge rotating roller, or the sheet bundle to which the saddle stitch processing or the like is performed in the sheet processing apparatus is discharged to the sheet discharge tray. In discharging the sheet, the shift movement is alternately performed in the horizontal direction by moving the rotating roller along with a rotating shaft in the direction of a rotating axial line, i.e., in the direction orthogonal to the sheet discharge direction. Therefore, the sheets or the sheet bundles are stacked on the sheet discharge tray while alternately offset in the horizontal direction.

When the rotating rollers are moved along with the rotating shafts in the axial line direction, it is necessary that the rotating rollers differ from each other in the shift amount according to a size of the sheet. However, in the conventional sheet sorting device, the speeds of the rotating rollers for discharging the sheet are set at a constant value by averaging the speeds at which the rotating rollers are moved along with the rotating shafts to alternately perform the shift movement in the horizontal direction of the rotating axial line. Therefore, there is the following problem to be solved.

In the rotating roller in which the necessary shift movement is small, the electric power consumption cannot be expected. This is because the rotating roller is set at a speed suitable for the large shift amount, even if the operating sound or the vibration of a drive mechanism can be suppressed by reducing the shift speed.

In the rotating roller in which the necessary shift movement is large, the productivity improvement cannot be expected. This is because the rotating roller is set at a speed suitable for the small shift amount, although an operating time can be shortened by increasing shift speed as much as possible to complete the shift.

SUMMARY OF THE INVENTION

An object of the invention is to provide an image forming apparatus in which the noises and vibration are suppressed, the electric power consumption is saved, and the productivity is improved by variably controlling the shift moving speed in the horizontal direction according to the shift amount when the sheets are automatically sorted.

Another purpose of the present invention is to provide a sheet conveyance apparatus of the invention includes a sheet conveyance unit which conveys a sheet while nipping the sheet; a moving unit which moves the sheet conveyance unit nipping the sheet toward a direction intersecting with a sheet conveyance direction; and a controller which controls the movement of the moving unit, wherein the controller controls a moving speed of the moving unit according to a predetermined moving amount of the moving unit.

Another purpose of the present invention is to provide a sheet processing apparatus of the invention performs processing to the sheet conveyed by the sheet conveyance apparatus.

Further purpose of the present invention is to provide an image forming apparatus of the invention includes an image forming part which forms an image on a sheet; a sheet conveyance apparatus of the invention which conveys the image-formed sheet; and a sheet processing apparatus which performs processing to the sheet conveyed by the sheet conveyance apparatus. According to the sheet conveyance apparatus of the invention, the moving speed is changed according to the moving amount of the sheet discharged from the image forming apparatus main body when the sheet is moved by the moving unit. That is, when the moving amount is set at a small value, the control is performed such that the moving speed of the moving unit is set at a low speed. Therefore, the generation of the noise and vibration can be suppressed to save the electric power consumption. When the moving amount is set at a large value, the operation time associated with the movement is shortened to eliminate waste of time by increasing the moving speed of the moving unit.

According to the image forming apparatus of the invention, when the moving amount is set at a large value in the moving unit, the moving speed is increased, so that high-speed processing can be performed to enhance the productivity as a whole.

Further features of the present invention will become apparent from the following description of exemplary embodiments (with reference to the attached drawings).

DESCRIPTION OF THE EMBODIMENTS

Preferred embodiments of a sheet conveyance apparatus, a sheet processing apparatus, and an image forming apparatus according to the invention will be described in detail with reference to the accompanying drawings.

(Image Forming Apparatus)

Figure 1:
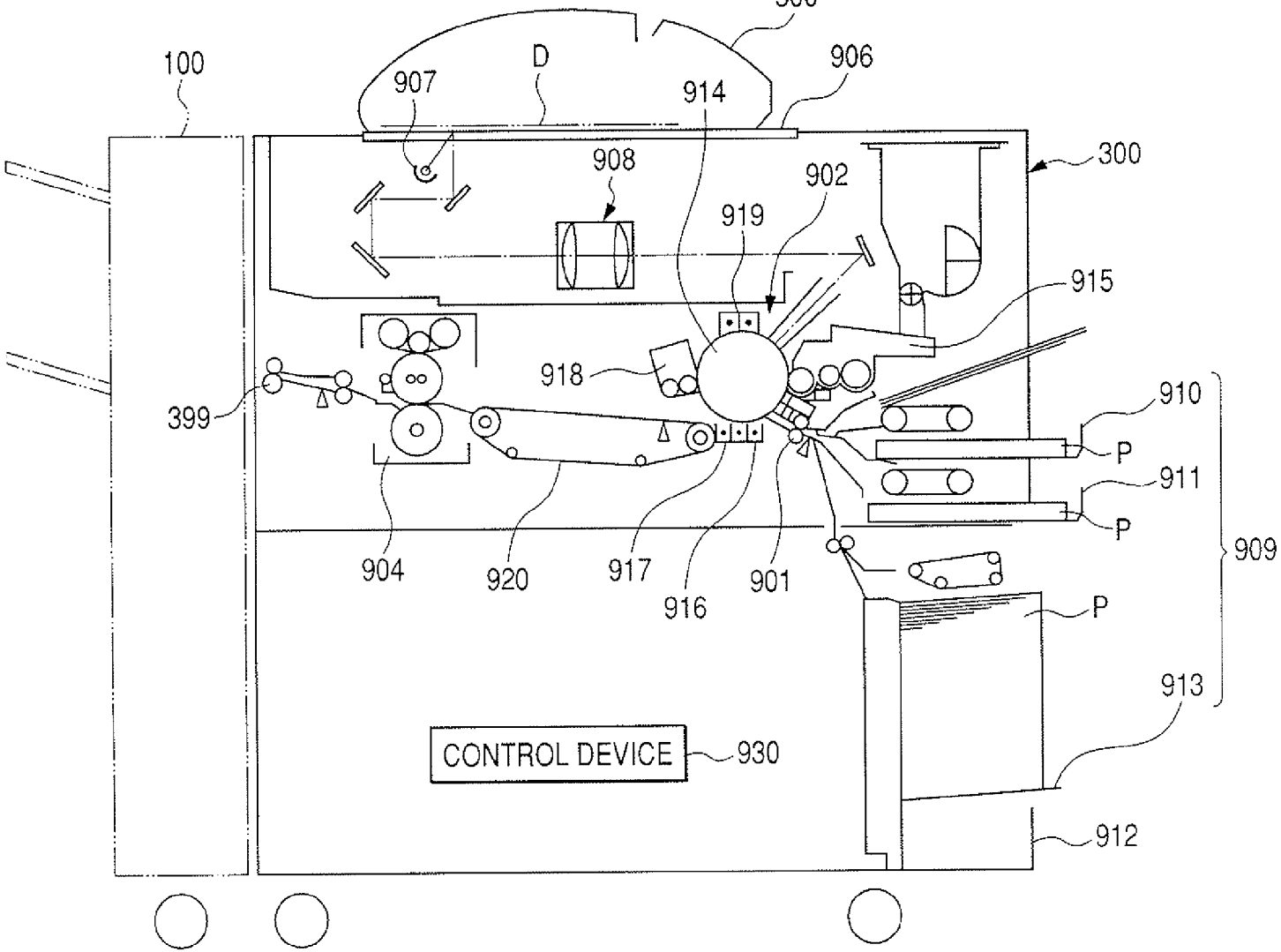
FIG. 1 is a general view showing an image forming apparatus main body and a sheet conveyance apparatus and a sheet processing apparatus, which are incorporated into the image forming apparatus main body according to an embodiment of the invention.

As shown in FIG. 1, an image forming apparatus main body 300 includes a platen glass 906, a light source 907, a lens system 908, and an automatic sheet feeder 500. The platen glass 906 is an original setting plate, and the automatic sheet feeder 500 feeds the original to the platen glass 906. The image forming apparatus main body 300 also includes a sheet supply unit 909 which supplies a sheet P (recording medium) to the image forming part 902. Sometimes the image forming apparatus main body 300 is provided with a sheet conveyance apparatus 100 which is of the sheet processing apparatus while sheet conveyance apparatus 100 is coupled to the image forming apparatus main body 300. In a function of the sheet conveyance apparatus 100, the image-formed sheet P discharged from the image forming part 902 is shifted in a direction intersecting with a sheet conveyance direction, and the sheet P is discharged while sorted in each print job. The sheet conveyance apparatus 100 includes a stapler, a saddle unit, and the like which are of the processing unit, and the sheet conveyance apparatus 100 performs the required processing as a finisher (sheet processing apparatus). The sheet conveyance apparatus 100 may integrally be incorporated in the image forming apparatus main body 300. For example, the sheet supply unit 909 accommodates the sheets P in two-tier sheet cassettes 910 and 911 while the sheets P are stacked, and the sheet supply unit 909 is detachably attached to the image forming apparatus main body 300. The sheet supply unit 909 also includes a deck 913 arranged in a pedestal 912. The sheet P supplied from each of the sheet cassettes 910 and 911 is delivered to the image forming part 902. The image forming part 902 includes a cylindrical photosensitive drum 914 which is of an image bearing member. The image forming part 902 includes a development device 915, a transferring charging device 916, a separation charging device 917, a cleaner 918, and a primary charging device 919 around the photosensitive drum 914. A conveyance device 920, a fixing device 904, and a discharge roller pair 905 are arranged on the downstream side of the image forming part 902.

The image forming apparatus main body 300 is provided with a control device 930 which is of a controller for controlling the whole apparatus, and the control device 930 outputs a control signal or an operation instruction signal to operate each unit and each device.

When the control device 930 outputs the signal for giving an instruction to supply the sheet P, the supply of the sheet P is started from the sheet cassette 910 or 911 or the deck 913. An original D on the original setting plate 906 is irradiated with light emitted from the light source 907, and the photosensitive drum 914 is irradiated through the lens system 908 with the light reflected from the original D. The photosensitive drum 914 is previously charged by the primary charging device 919, and an electrostatic latent image is formed on the photosensitive drum 914 by the light irradiation. Then, the electrostatic latent image is developed to form a toner image with the development device 915.

In the sheet P supplied from the sheet supply unit 909, skew movement is corrected by a registration roller 901. Then, the sheet P is delivered to the image forming part 902 at predetermined timing. In the image forming part 902, the toner image on the photosensitive drum 914 is transferred to the sheet P by the transferring charging device 916, the separation charging device 917 charges the toner-image-transferred sheet P in a polarity opposite to the transferring charging device 916, and thereby the toner-image-transferred sheet P is separated from the photosensitive drum 914. The conveyance device 920 conveys the separated sheet P to the fixing device 904, and the fixing device 904 permanently fixes the transferred image onto the sheet P. The image-fixed sheet P is discharged from the image forming apparatus main body 300 by a discharge roller pair 399 in a straight sheet-discharge mode in which the image surface is orientated upward. Alternatively, the image-fixed sheet P is conveyed to a sheet reverse path after the image is fixed, and the image-fixed sheet P is discharged from the image forming apparatus main body 300 by a discharge roller pair 399 in a reverse sheet-discharge mode in which the image surface is orientated downward by the reversal. Thus, the image is formed on the sheet P supplied from the sheet supply unit 909, and the sheet P is discharged toward the sheet conveyance apparatus 100. Then, a configuration of the sheet conveyance apparatus 100 will be described.

(Sheet Conveyance Apparatus)

Figure 2:
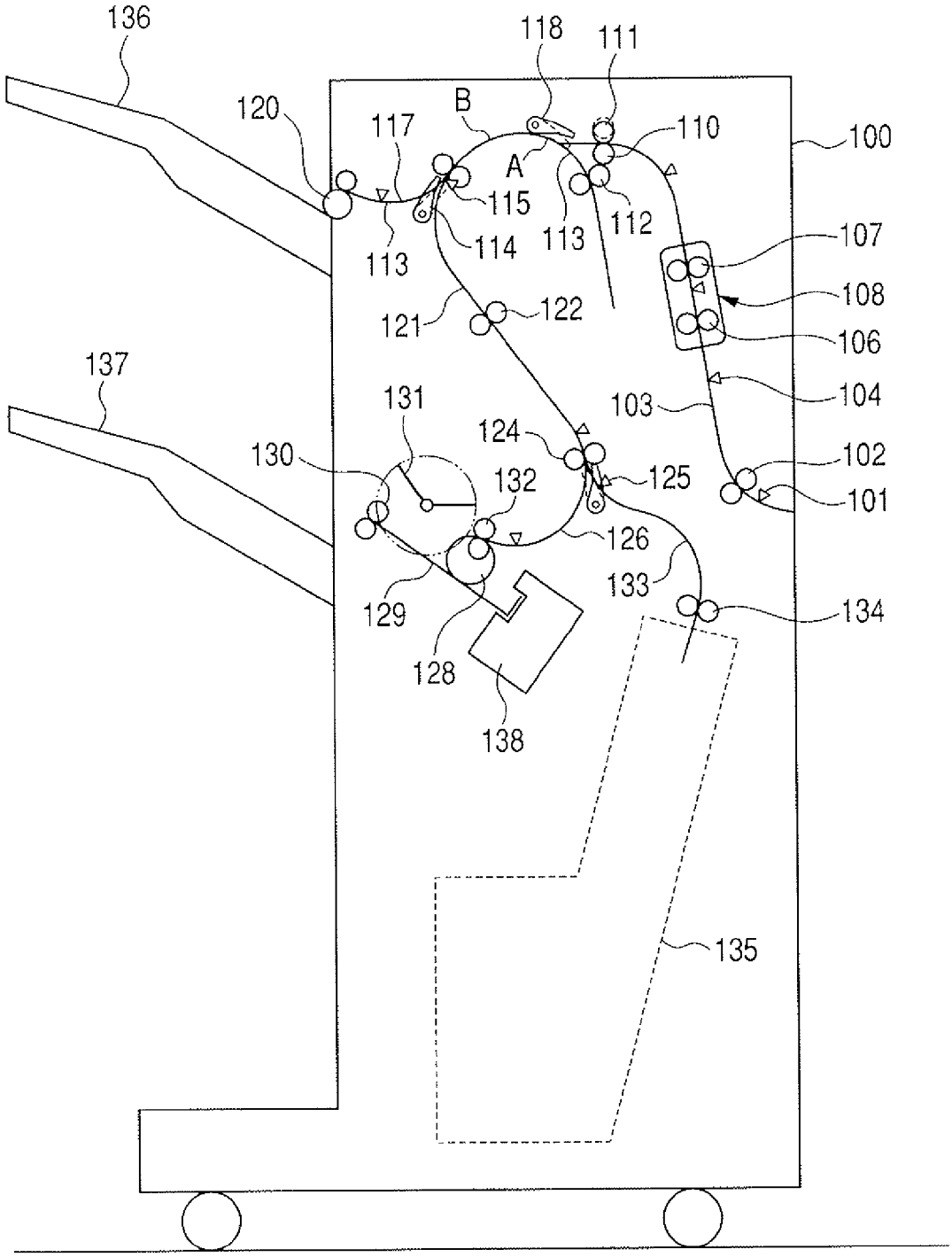
FIG. 2 is a sectional view showing the sheet conveyance apparatus and the sheet processing apparatus of the embodiment.

As shown in FIG. 2, the sheet conveyance apparatus 100 includes an entrance-side roller pair 102 which receives the image-formed sheet P discharged from the image forming apparatus main body 300. An entrance sensor 101 is arranged near the entrance-side roller pair 102 to simultaneously detect timing of receiving the sheet P. The entrance-side roller pair 102 delivered the sheet P to a conveyance path 103, and a traverse direction deviation detection sensor (detection part) 104 detects a conveyance state of the sheet P.

Figure 5:
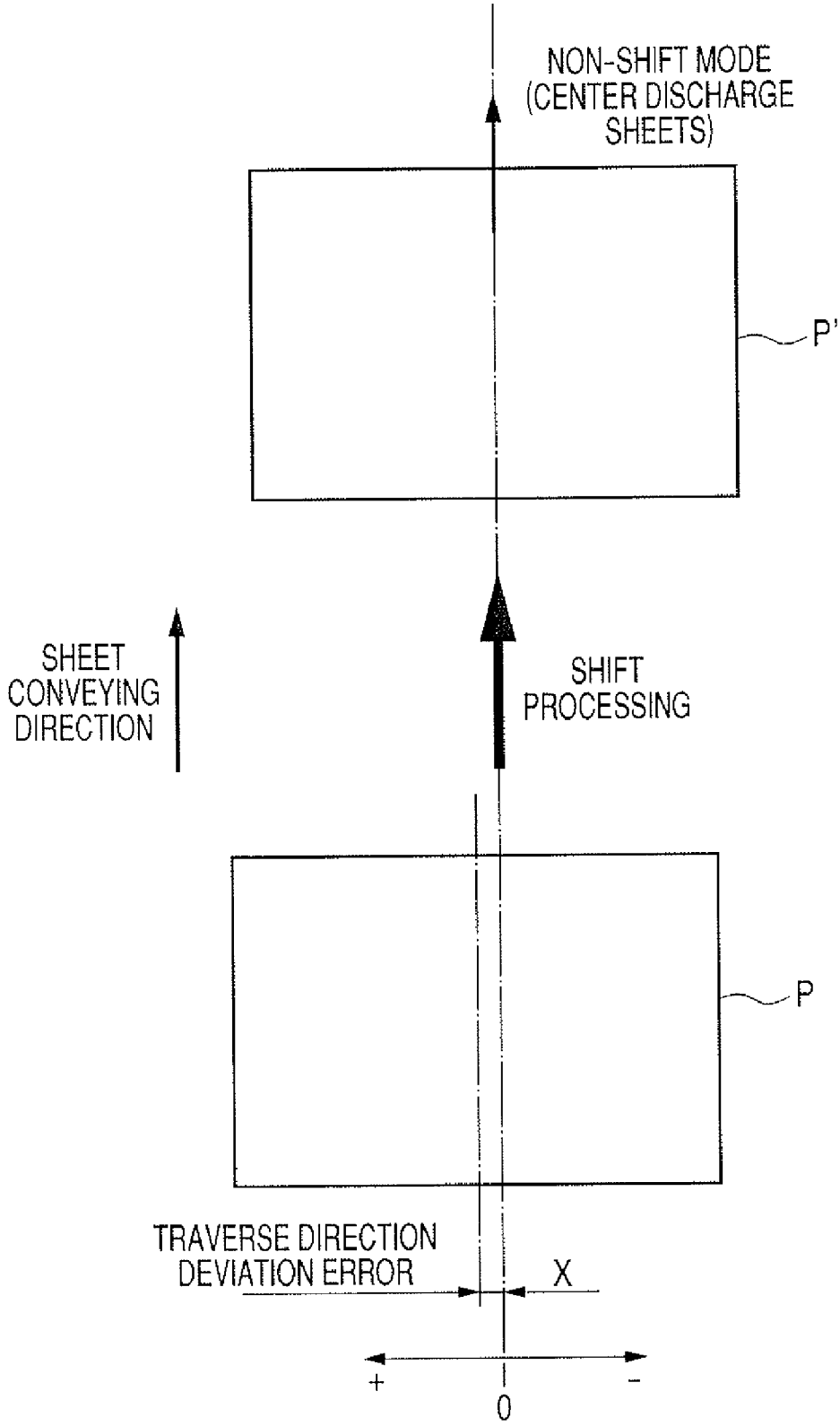
FIG. 5 is a schematic view showing a non-shift mode of the embodiment.

As used herein, "deviation (shift) in the traverse direction" shall means that the sheet P discharged from the image forming apparatus main body 300 is delivered which shifted toward the direction orthogonal to the sheet-discharge direction with respect to the sheet conveyance apparatus 100. FIG. 5 shows a non-shift (center sheet discharge) mode in which the sheet P or a sheet bundle is delivered based on a sheet center line along the sheet conveyance direction with respect to an upper tray 136 or a lower tray 137 in the sheet conveyance direction (vertical direction of FIG. 5). That is, the non-shift mode is a shift mode when the sheets P are stacked while the center in the direction orthogonal to the discharge direction of one sheet P is aligned with a reference on the upper tray 136. When the non-shift mode is selected, a shift moving amount determined by the shift mode becomes 0 (zero), because the sheet P or the sheet bundle is delivered based on the sheet center line along the sheet conveyance direction. In this case, the sheet P is delivered from the image forming apparatus main body 300 while shifted by an error amount X caused by the deviation in the traverse direction, and the correction is performed such that the shift moving amount of the sheet P corresponding to the amount of deviation in the traverse direction (error amount) X becomes the shift moving amount (hereinafter simply referred to shift amount) of the shift moving unit 108.

Figure 9:
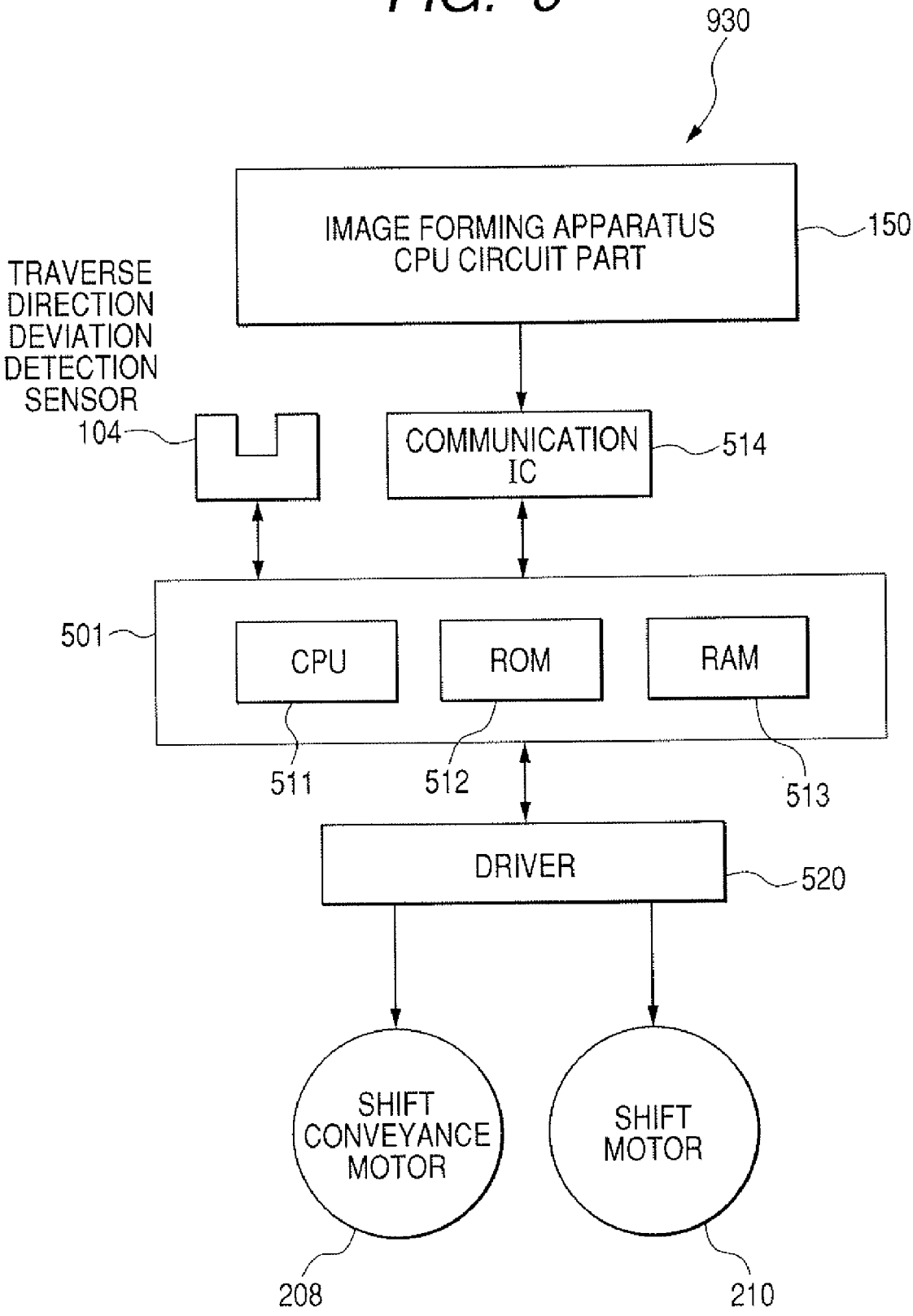
FIG. 9 is a functional block diagram showing a configuration of a control unit of a sheet post-processing apparatus (finisher) according to the embodiment.

The traverse direction deviation detection sensor 104 always monitors the deviation in the traverse direction of the sheet P delivered from the image forming apparatus main body 300, and the traverse direction deviation detection sensor 104 transmits detection result as shift information to the control device 930. The control device 930 determined whether the amount of deviation in the traverse direction is added or subtracted according to the shift direction with respect to the reference, and the control device 930 computes how much a shift moving unit (moving unit) 108 is totally shifted from a home position (initial position) in order that the sheet P is aligned based on the sheet center line along the sheet conveyance direction. Then, the control device 930 outputs the operation signal. In the embodiment, the control device 930 which controls the whole apparatus controls both the image forming apparatus main body 300 and the sheet conveyance apparatus 100. However, in the configuration where the sheet conveyance apparatus 100 includes a finisher control unit 501 (see FIG. 9), the shift moving unit 108 may be controlled through the finisher control unit 501 from the control device 930 on the side of the image forming apparatus main body 300. In the embodiment, the home position is placed in the center. Therefore, magnitude of the amount of deviation in the traverse direction corresponds to magnitude of the shift amount in the case of the non-shift mode, and it is necessary to perform the computation while the amount of deviation in the traverse direction is added to or subtracted from the shift amount between the home position and the shift position in the cases of a front-shift mode and a rear-shift mode described later with reference to FIGS. 6 and 7.

Figure 3:
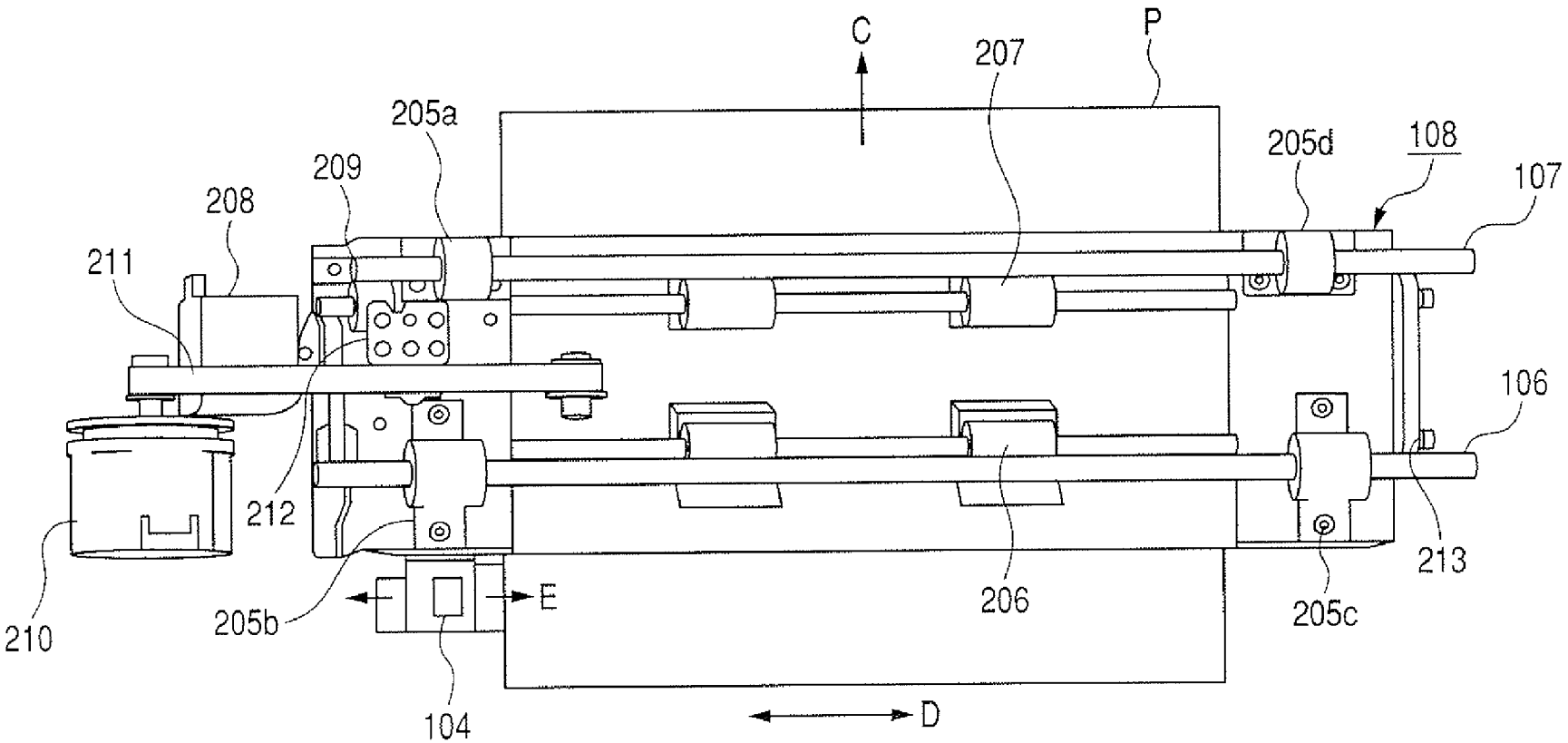
FIG. 3 is a plan view showing a shift moving unit of the embodiment.
Figure 4:
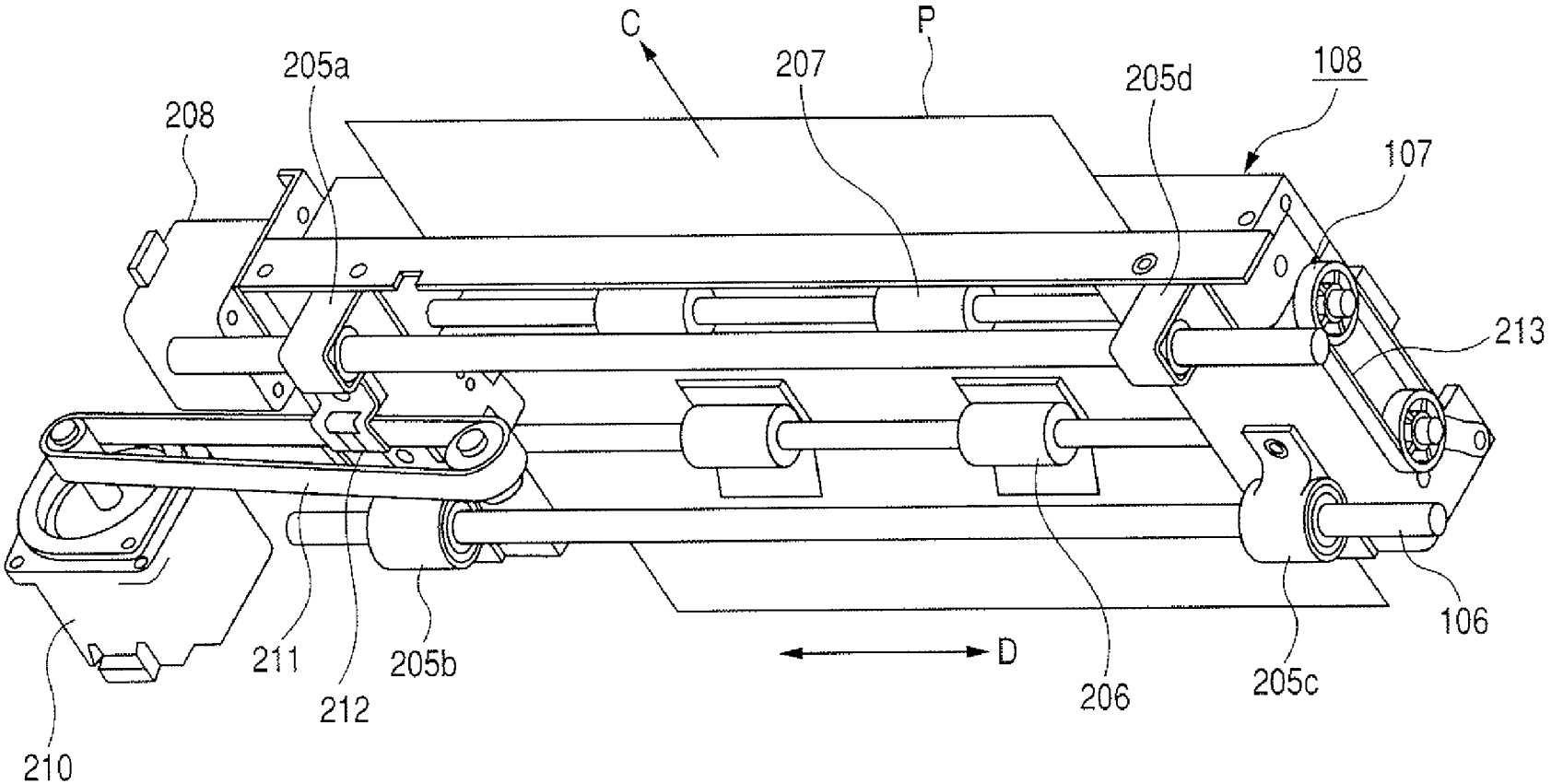
FIG. 4 is a perspective view showing the shift moving unit.

A configuration and an operating mode of the shift moving unit 108 which is of the moving unit will be described below with reference to FIGS. 3 and 4.

The image-formed sheet P is discharged from the image forming apparatus main body 300, the sheet P is delivered to the conveyance path 103 of the sheet conveyance apparatus 100, and the sheet P is conveyed through the conveyance path 103. Then, the sheet P is delivered to the shift moving unit 108. The shift moving unit 108 includes a sheet conveyance motor 208, and the sheet conveyance motor 208 starts the drive by the operation signal outputted by the delivery of the sheet P to the sheet conveyance motor 208. The outputted motor revolving power is transmitted to a drive belt 209 to rotate a sheet conveyance roller 206. A sheet conveyance roller 207 is also rotated by the motor revolving power transmitted to the drive belt 213, and the sheet P is conveyed along the sheet conveyance direction shown by an arrow C in FIGS. 3 and 4. The sheet conveyance rollers 206 and 207 constitute the sheet conveyance unit. At this point, the traverse direction deviation detection sensor 104 is moved toward the direction of an arrow E by a drive unit (not shown) such as a solenoid, and the traverse direction deviation detection sensor 104 detects the error amount "X" caused by the deviation in the traverse direction of the sheet P (see FIG. 5). The position of the sheet P is corrected such that the amount of deviation X is added to or subtracted from the shift amount of the sheet P to align the sheet P with the center by the computed shift amount Z. Therefore, the control device 930 moves the shift moving unit 108 toward the shift direction from the home position. The shift direction shall mean a crosswise direction orthogonal to the sheet conveyance direction, and the shift direction shall mean the direction of an arrow D in FIGS. 3 and 4.

The whole of the shift moving unit 108 is guided by a pair of parallel slide rails 106 and 107 fixed to the sheet conveyance apparatus 100, and the shift moving unit 108 is reciprocally moved in the shift direction of the arrow D orthogonal to the sheet conveyance direction C through slide bushings 205*a* to 205*d*. The control device 930 outputs and sends a drive-on signal to the shift drive motor 210, and the control device 930 causes the drive belt 211 to run by the motor revolving power. The shift moving unit 108 slides on the slide rails 106 and 107 in the direction of the arrow D through a transmission plate 212 which is anchored and fixed to the drive belt 211. While the sheet P is conveyed toward the direction of the arrow C by the shift movement of the shift moving unit 108 with the sheet P nipped by the sheet conveyance rollers 206 and 207, the position correction is performed to the sheet P by the error amount X caused by the deviation in the traverse direction, and the sheet P is aligned on the center line of the conveyance path 103. For example, as shown in FIG. 5, it is assumed that the sheet P is delivered to the sheet conveyance apparatus 100 while shifted from the image forming apparatus main body 300 by the amount of deviation X. In this case, the shift moving unit 108 corrects the amount of deviation X of the sheet P, and the sheet P is stacked while aligned with the center of the upper tray 136.

At this point, while the position of the sheet P is corrected in the direction of the arrow D by the shift movement, the sheet P is securely nipped by the pair of sheet conveyance rollers 206 and 207 which is of the sheet conveyance unit, and the sheet P is conveyed toward the sheet conveyance direction C. According to the above configuration, the sheet skew is not generated even when the sheet P has a large size such as A3 size. That is, when a front end portion or a rear end portion of the large-size sheet P reaches a curved point of the conveyance path 103, the sheet P is firmly nipped by the two sheet conveyance rollers 206 and 207, which overcomes moment generated by slide resistance. As a result, the sheet skew movement caused by the generation of slip between the sheet and the sheet conveyance rollers 206 and 207 is never generated during the shift movement, so that the sheet P can stably be conveyed while the shift movement is performed.

Figure 6:
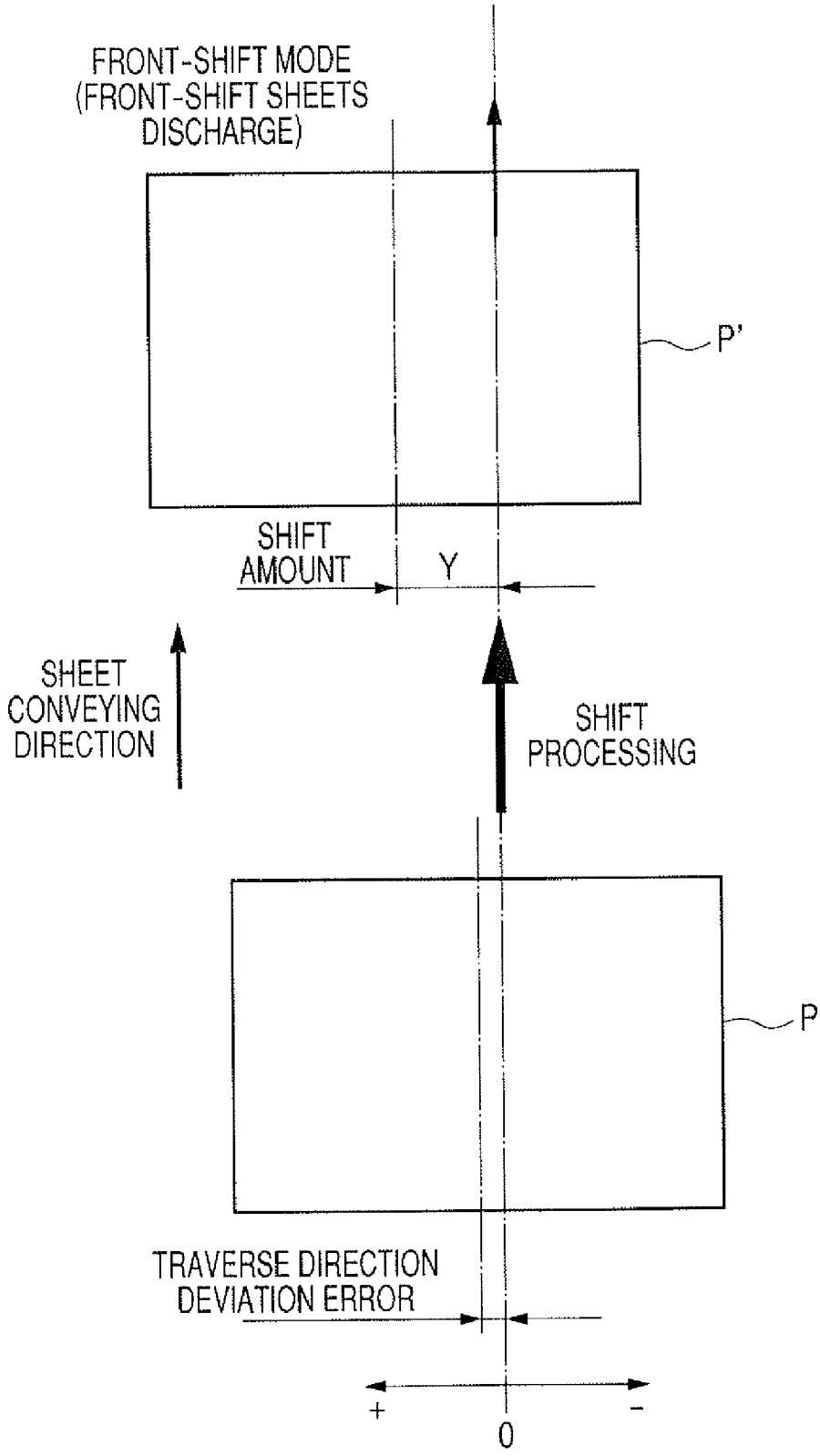
FIG. 6 is a schematic view showing a front-shift mode of the embodiment.
Figure 7:
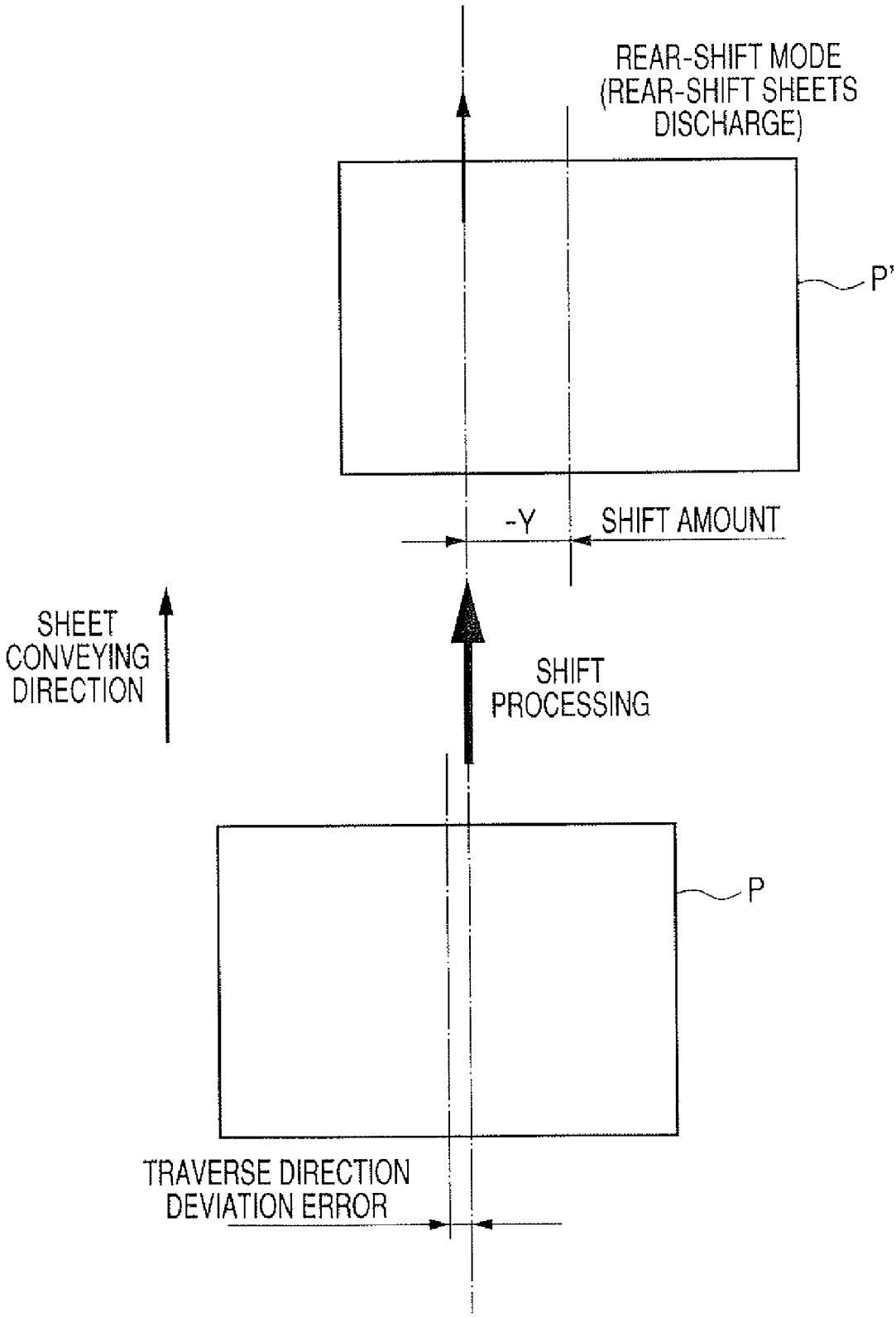
FIG. 7 is a schematic view showing a rear-shift mode of the embodiment.

FIG. 5 shows the non-shift mode of the shift moving unit 108, FIG. 6 shows the front-shift mode of the shift moving unit 108, and FIG. 7 shows the rear-shift mode of the shift moving unit 108. In the embodiment, the shift mode basically includes the three modes of the non-shift mode, the front-shift mode, and the rear-shift mode. In the embodiment, as shown in FIG. 1, the image forming apparatus main body 300 and the sheet conveyance apparatus 100 are installed so as to face a user. An operation panel (not shown) which the user operates is provided in a front surface of the image forming apparatus main body 300. That is, the shift moving unit 108 is arranged so as to be able to be shifted in a depth direction of the apparatus, the front-shift mode is a mode in which the shift moving unit 108 is shifted toward the front side of the apparatus, and the rear-shift mode is a mode in which the shift moving unit 108 is shifted toward the rear side of the apparatus. Usually the front-shift mode and the rear-shift mode are alternately performed in each sheet bundle in order to identify each sheet bundle. For example, the preceding sheet bundle is shifted by the front-shift mode, and the subsequent sheet bundle is shifted by the rear-shift mode, which allows the sheet bundles to be stacked while offset in the crosswise direction from the center position of the upper tray 136. The installation orientations of the image forming apparatus main body 300 and sheet conveyance apparatus 100 are not limited to the above case, but the case is illustrated by way of example for the purpose of explanation of the front-shift mode and the rear-shift mode.

In the non-shift mode (center discharge sheet) of FIG. 5, the sheet P discharged from the image forming apparatus main body 300 is delivered to the conveyance path 103 of the sheet conveyance apparatus 100 while the error amount "X" is generated by the deviation in the traverse direction. The traverse direction deviation detection sensor 104 detects the amount of deviation X of the sheet P, the control device 930 performs the computation based on the detection signal of the traverse direction deviation detection sensor 104, and the control device 930 computes a necessary shift amount Z1 by which the shift moving unit 108 should be moved from the following formula (1).

$$Z1=X\times(-1) \quad (1)$$

When the shift moving unit 108 is moved by the necessary shift amount Z1, the sheet P is conveyed on the center line of the conveyance path 103 and, for example, the sheet P can be discharged to "center position" of the upper tray 136. The reference symbol P' in FIG. 5 denotes the sheet to which the position correction is already performed. Where X indicates an absolute value of the error amount and (−1) indicates that the movement is performed toward the right in FIG. 5.

In the front-shift mode (front-shift sheet discharge), the shift moving unit 108 is moved to the position where the shift moving unit 108 is separated away from the home position by "Y". FIG. 6 shows the case in which the sheet P discharged from the image forming apparatus main body 300 is delivered while shifted toward the front side from the center position of the sheet conveyance apparatus 100 by the error amount "X" caused by the deviation in the traverse direction. The traverse direction deviation detection sensor 104 detects the error amount X of the sheet P, the control device 930 performs the computation based on the detection signal of the traverse direction deviation detection sensor 104, and the control device 930 computes a necessary shift amount Z2 by which the shift moving unit 108 should be moved from the following formula (2).

$$Z2=Y-X \quad (2)$$

When the shift moving unit 108 is moved by the necessary shift amount Z2, the position of the sheet P is corrected to the position where the sheet P is moved by "Y" toward the front side of the sheet conveyance apparatus and, for example, the sheet P can be stacked while offset from the center position of the upper tray 136 toward the front side of the sheet conveyance apparatus (see the reference symbol P' in FIG. 6).

In the rear-shift mode (rear-shift sheet discharge), the sheet P discharged from the image forming apparatus main body 300 is delivered while shifted toward the rear side from the center position of the sheet conveyance apparatus 100 by the error amount "X" caused by the deviation in the traverse direction. The traverse direction deviation detection sensor 104 detects the amount of deviation X of the sheet P, the control device 930 performs the computation based on the detection signal of the traverse direction deviation detection sensor 104, and the control device 930 computes a necessary shift amount Z3 by which the shift moving unit 108 should be moved from the following formula (3).

$$Z3=Y+X \quad (3)$$

When the shift moving unit 108 is moved by the necessary shift amount Z3, the position of the sheet P is corrected to the position where the sheet P is moved by "Y" toward the rear side of the sheet conveyance apparatus and, for example, the sheet P can be stacked while offset from the center position of the upper tray 136 toward the rear side of the sheet conveyance apparatus (see the reference symbol P' in FIG. 7).

Thus, the control device 930 determines the moving speed of the shift moving unit 108 according to each of the necessary shift amounts Z1, Z2, and Z3 computed from the formulas (1), (2), and (3). When the necessary shift amounts Z1, Z2, and Z3 are small, the control device 930 moves the shift moving unit 108 at low speed.

The maximum shift amount of the shift moving unit 108 is defined as $Z_{max}$. For example, the shift amount range is divided by $Z_{max}/2$ so as to correspond to the center line position, which is of the center in the crosswise direction of the sheet, along the sheet moving direction. The moving speed of the shift moving unit 108 is set at V1 in the shift amount range of 0 to $Z_{max}/2$, and the moving speed of the shift moving unit 108 is set at V2 in the shift amount range of $Z_{max}/2$ to $Z_{max}$. In this case, the moving speed of the shift moving unit 108 is set to V1<V2 such that the moving speed is reduced when the shift amount is small.

However, it is not always necessary that the shift amount range of the sheet be divided at the center in the crosswise direction of the sheet. That is, it is not always necessary that the shift amount range be divided by the $Z_{max}/2$. The shift amount range may arbitrarily be determined according to apparatus specifications. In the embodiment, the shift amount range is divided into the two ranges. The division of the shift amount range is not limited to the two ranges, but the shift amount range may be divided into at least three ranges.

Thus, the control device 930 variably controls the shift moving speed of the shift moving unit 108 according to the shift amount. That is, when the necessary shift movement is small, the control device 930 moves the shift moving unit 108 at low speed. Therefore, the noise and vibration generated from the shift drive motor 210 constituting the drive system of the shift moving unit 108 can be decreased to the minimum. The low-speed movement also saves the electric power consumption. On the contrary, when the necessary shift movement is large, the shift moving speed of the shift moving unit 108 is increased to end the movement as fast as possible. Therefore, the operating time can be shortened to contribute to the total productivity improvement in the image forming apparatus main body 300. However, even in this case, the control device 930 can perform the control through the finisher control unit 501 incorporated into the sheet conveyance apparatus 100.

Figure 8:
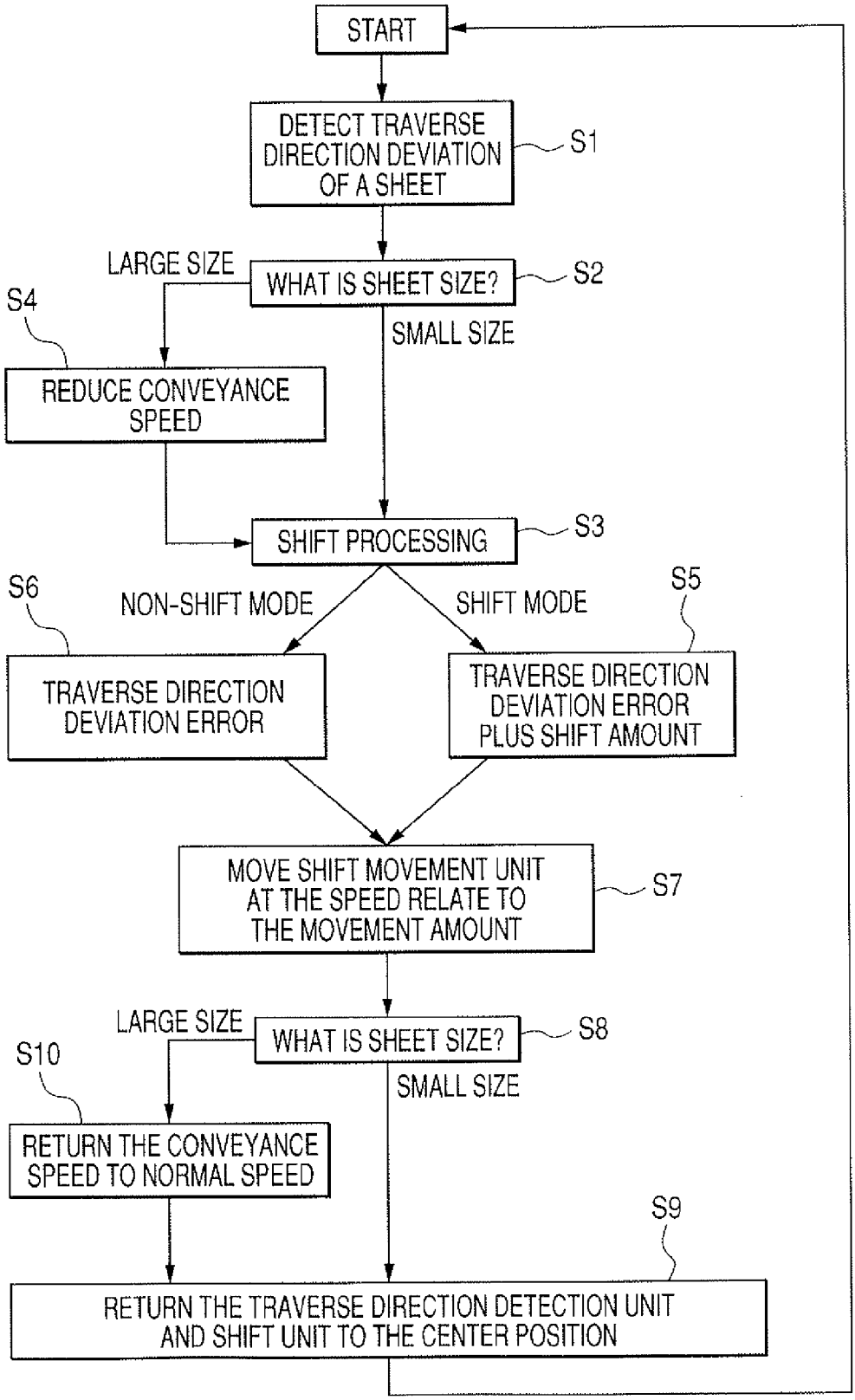
FIG. 8 is a flowchart showing an operation of the shift moving unit of the embodiment.

As shown in a flowchart of FIG. 8, the control of the shift moving speed of the shift moving unit 108 can be associated with the size of the sheet P which is discharged from the image forming apparatus main body 300 and delivered to the sheet conveyance apparatus 100.

Referring to the flowchart of FIG. 8, the traverse direction deviation detection sensor 104 detects the deviation in the traverse direction of the sheet P conveyed to the sheet conveyance apparatus 100 (Step S1). The control device 930 determines the shift amount for performing the offset movement of the sheet P based on the detection value and the mode, and the control device 930 determines the shift speed of the shift moving unit 108 according to the necessary shift amount. Then, the control device 930 determines whether the sheet size is the small size or the large size (Step S2). The sheet P having the length in the conveyance direction which is equal to or smaller than an LTR (216 mm) size is defined as the small size. The sheet P having the length larger than the LTR size is defined as the large size. For the small size, because the shift processing is completed before the front end portion of the sheet P reaches the conveyance roller 110 and the separable roller 111, the separable roller 111 receives the sheet P while pressurized. For the large size, the sheet P is conveyed while the separable roller 111 is in the separate state (position shown by broken line of FIG. 2). Then, after the shift operation is performed by the shift moving unit 108, the separable roller 111 becomes the pressurized state and the separable roller 111 conveys the sheet P while nipping the sheet P.

At this point, in order to shorten a distance between the sheet conveyance roller 107 and the second buffer roller pair 115 (in this case, the roller pair does not separate), the conveyance speed is reduced to a predetermined speed before the sheet is shifted in the case of the large size (Step S4). This control enables the path length, where the sheet P is not nipped, to be shortened to perform the shift movement of the sheet P except for the sheet conveyance rollers 206 and 207. The shift moving unit 108 starts the shift processing for the sheet P in the conveyance path 103 according to the already set mode such as the shift mode and the non-shift mode (Step S3).

When the front-shift mode or the rear-shift mode is selected, the predetermined shift amount is determined. The control device 930 computes the moving amount (actual shift amount) of the shift moving unit 108 while the error amount X, which is detected by the traverse direction deviation detection sensor 104 and caused by the deviation in the traverse direction of the sheet P, is added to or subtracted from the predetermined shift amount (Step S5).

When the non-shift mode is selected, because the shift amount is 0 (zero), the control device 930 computes the moving amount (actual shift amount) of the shift moving unit 108 only with the error amount X which is detected by the traverse direction deviation detection sensor 104 and caused by the deviation in the traverse direction of the sheet P (Step S6). Thus, the control device 930 determines the moving speed of the shift moving unit 108 according to the moving amount. That is, the control device 930 shifts shift moving unit 108 at low moving speed when the moving amount is small, and the control device 930 shifts the shift moving unit 108 at high moving speed when the moving amount is large (Step S7).

After the shift moving unit 108 is shifted, when the sheet P is the large size (Step S8), the conveyance speed which is reduced before the shift is returned to the normal speed (Step S10). Finally, the traverse direction deviation detection sensor 104 and the shift moving unit 108 are returned to the home position (center position), and a sequence of operations is ended (Step S9). Then, the flow returns to the start of the sequence, and the same operations are repeated for the necessary number.

In the sheet conveyance apparatus 100 which is of the sheet processing apparatus, the sheet processing such as staple processing and saddle stitch processing is performed as follows. First a configuration of a finisher control unit 501 which controls the conveyance drive and post-processing of the sheet conveyance apparatus 100 will schematically be described with reference to a functional block diagram of FIG. 9.

The finisher control unit 501 has a CPU circuit part 510 including a CPU 511, a ROM 512, and a RAM 513. The CPU circuit part 510 performs data exchange by communicating with a CPU circuit part 150 provided on the image forming apparatus main body side through a communication IC 514, the CPU circuit part 510 executes various programs stored in the ROM 512 to perform the drive control of the sheet conveyance apparatus 100 based on the instruction from the CPU circuit part 150. In performing the drive control, the CPU circuit part 150 captures the detection signals from various sensors. The various sensors include the transverse direction deviation detection sensor 104. A driver 520 is connected to the CPU circuit part 510, and the driver 520 drives the motor and the solenoid based on the signal from the CPU circuit part 510. The motor includes the shift conveyance motor 208 which is of the drive source of the shift roller pair 107 and the shift motor 210 which is of the drive source of the shift unit 108. The shift conveyance motor 208 and the shift motor 210 are formed by a stepping motor. In the shift conveyance motor 208 and the shift motor 210, the roller pair driven by each motor is rotated at constant speed or at unique speed by controlling a magnetic excitation pulse rate. The shift motor can be driven in normal and reverse rotating directions by the driver 520.

Referring to FIG. 2, the sheet P conveyed by the conveyance roller 110 and the separable roller 111 is conveyed by the second buffer roller pair 115. Then, when the sheet P is discharged to the upper tray 136, an upper path switching flapper 114 becomes the state shown by the broken line of FIG. 2 by a drive unit such as the solenoid. After the sheet P is guided to an upper conveyance path 117, the sheet P is discharged to the upper tray 136 by an upper sheet-discharge roller 120. When the sheet P is not discharged to the upper tray 136, the sheet P conveyed by the second buffer roller pair 115 is guided to the conveyance path 121 by the upper path switching flapper 114. Then, the sheet P is passed through the conveyance path by a third buffer roller pair 122 and a conveyance roller pair 124.

In the sheet conveyance apparatus 100 which is of the sheet processing apparatus, a saddle unit 135 which is of the processing unit performs the saddle stitch processing to the sheet P. In this case, a saddle path switch flapper 125 is operated to the position shown by the broken line by the drive unit such as the solenoid, which allows the sheet P to be conveyed to a saddle path 133. Then, the sheet P is guided to the saddle unit 135 which is of the processing unit by a saddle entrance roller pair 134, and the saddle stitch processing is performed.

On the other hand, when the sheet P is discharged to the lower tray 137, the following operations are performed. The sheet P conveyed by the conveyance roller pair 124 is conveyed to a lower path 126 by the saddle path switch flapper 125. Then, the sheet P is discharged to a processing tray 129 by a lower discharge roller pair 132, and alignment processing is performed to each predetermined number of sheets on the processing tray 129 by a returning member including a paddle 131 and a roulette belt 128. Then, binding processing is performed if needed by a stapler 138 which is of the processing unit, the bundle of sheets P is discharged to the lower tray 137 by a bundle sheet discharge roller pair 130.

Usually it takes a predetermined time longer than a sheet interval to perform the staple processing or the saddle stitch processing. Therefore, so-called sheet buffer processing will be described below. The sheet buffer processing is one in which the sheet processing is performed without stopping the image formation in the image forming part 902.

Figure 10:
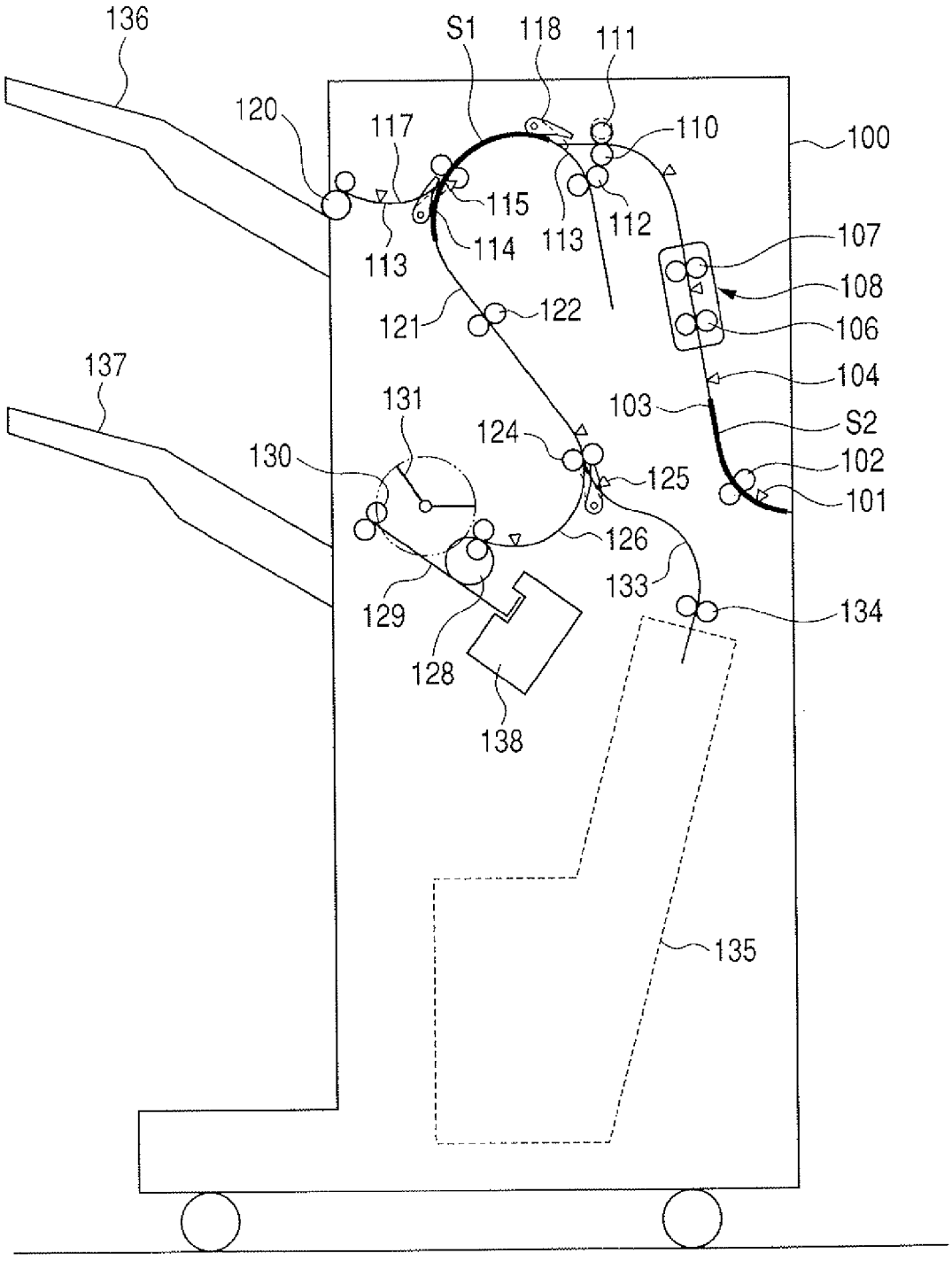
FIG. 10 is a sectional view showing a sheet conveyance operation in the embodiment.
Figure 11:
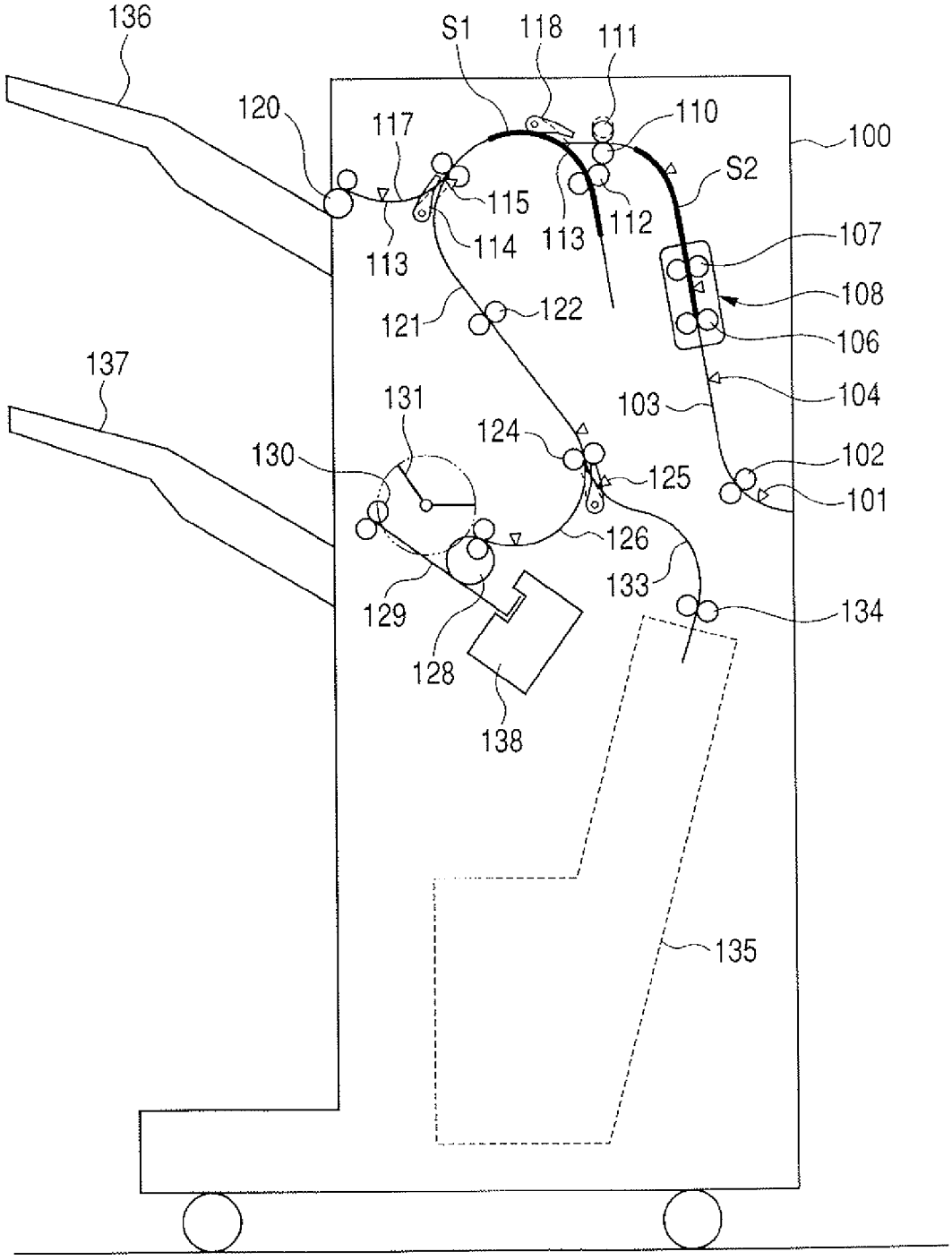
FIG. 11 is a sectional view showing a sheet conveyance operation in the embodiment.
Figure 12:
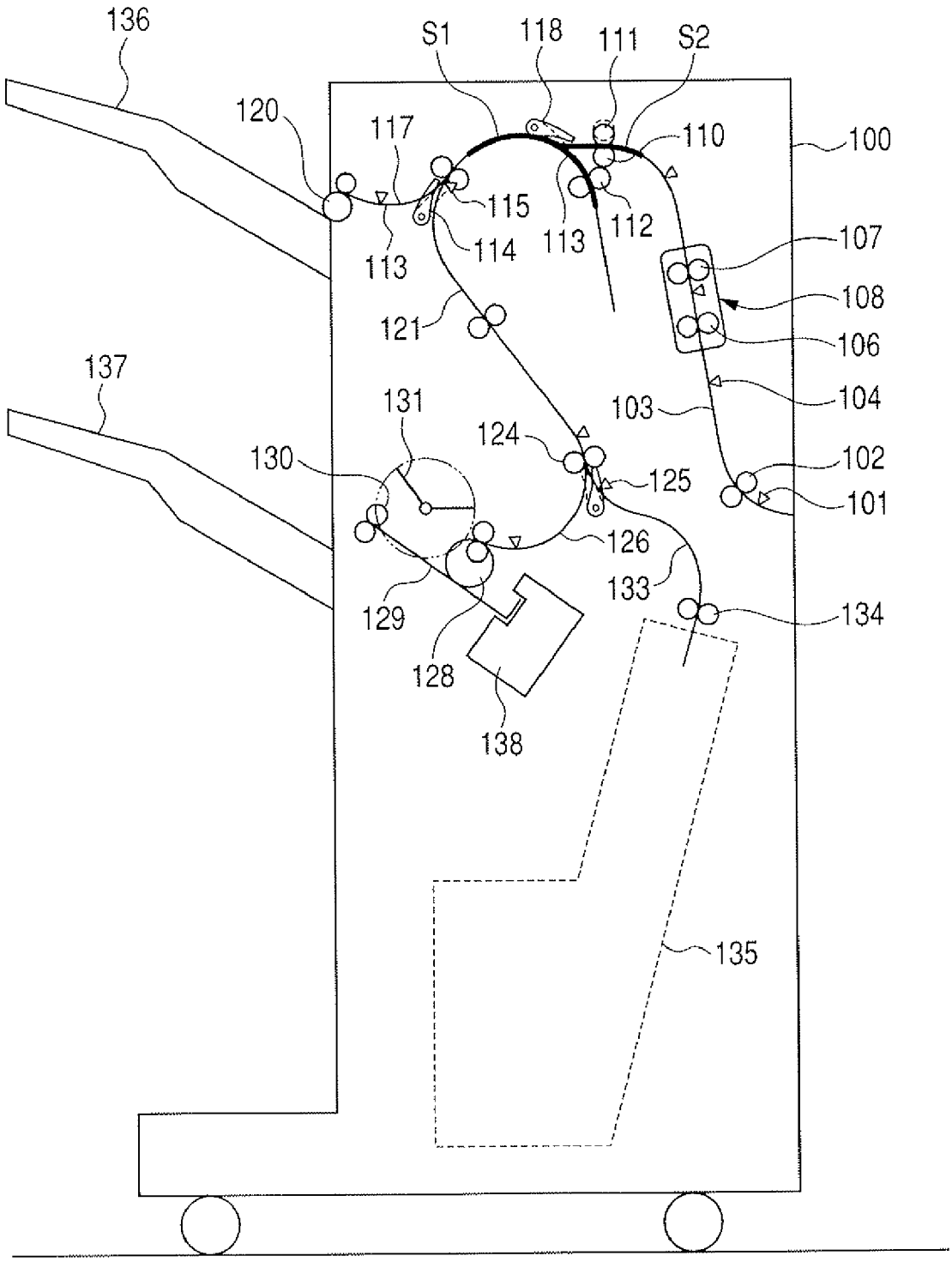
FIG. 12 is a sectional view showing a sheet conveyance operation in the embodiment.

FIGS. 10 to 12 shows the sheet buffer processing performed in the sheet conveyance apparatus 100 which is of the sheet post-processing apparatus (finisher). As shown in FIG. 10, in the sheets P conveyed by the conveyance roller 110 and the separable roller 111, the preceding sheet (hereinafter denoted by the reference symbol S1) is guided to the conveyance path 121 by the second buffer roller pair 115. At this point, the front-end position of the sheet S1 is detected by a buffer sensor 116. The size of the sheet S1 and the like are recognized by the previous size information. On the basis of the size information, the control for stopping the rotation of the second buffer roller pair 115 is performed such that the sheet S1 is stopped at a stage when the rear-end position of the sheet S1 reaches a point A. The buffer path switch flapper 114 is operated to the position shown by the broken line, and the second buffer roller pair 115 is reversely rotated to guide the rear end of the sheet S1 to a buffer path 113. As shown in FIG. 11, the sheet S1 is reversely conveyed until the front-end position of the sheet S1 reaches a point B. Then, the subsequent sheet S2 is conveyed. When the buffer sensor 109 detects the front-end position of the sheet S2, the drive of the first buffer roller pair 112 is started such that the front-end position of the sheet S2 is located at the same position as the front-end position of the sheet S1 while the preceding sheet S1 reaches the conveyance speed. Therefore, as shown in FIG. 12, the front-end positions of the preceding sheet S1 and the subsequent sheet S2 are aligned with each other.

When another sheet P is further overlaid on the sheets S1 and S2, the drive of the second buffer roller pair 115 is continued until the rear-end positions of the sheets S1 and S2 reach the point A. Then, the above-described processing is repeated to perform the overlaying processing of another sheet P. After the overlaying processing is performed to the predetermined number of sheets P, the sheet bundle is conveyed to the processing unit or the saddle unit by the third buffer roller pair 122 and the conveyance roller pair 124.

Although the reversal type buffer unit is described in the embodiment, the invention is not limited to the reversal type buffer unit. However, the same effect can also be obtained by a rotary buffer unit or the buffer units of other types. Because the buffer unit is not always included in the sheet processing apparatus of the invention, there is no problem when the sheet processing apparatus is not provided with the buffer unit.

Figure 13:
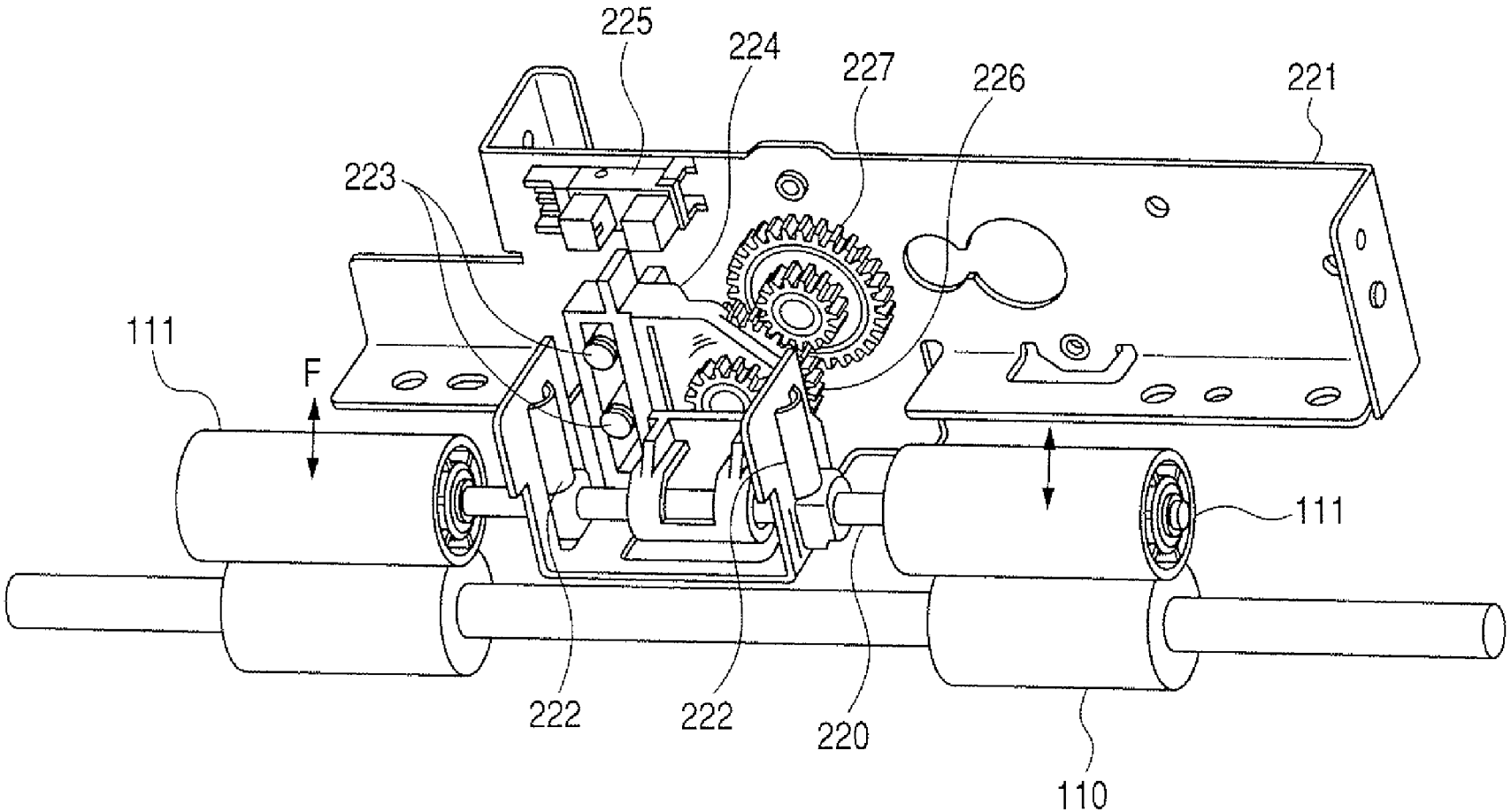
FIG. 13 is a perspective view showing a configuration of a separable roller and a neighboring structure in the embodiment.

As shown in FIG. 13, in the embodiment, the separable roller 111 can be configured as follows. The separable roller 111 is pressurized against the conveyance roller 110. The separable roller 111 is pressurized by pressing the separable roller 111 with a compression spring 222 which is of a pressurizing member. A separable frame 224 is arranged so as to be guided in the direction of the arrow of FIG. 13 by a guide shaft 223 fixed to a frame 221. When a revolving power is transmitted to a drive gear 227 from a drive unit (not shown) such as a stepping motor, a drive gear 226 arranged on the downstream side of the drive gear 227 is sequentially driven, and a rack provided in the drive frame 224 is driven, which allows the drive frame 224 to be moved. When the revolving power is transmitted counterclockwise to the drive gear 227, the drive frame 224 is moved in the separate direction (F direction). The position of separable roller 111 can be recognized by measuring the moving amount from the home position sensor 225. Accordingly, the separate and pressurizing states of the separable roller 111 can appropriately be controlled by controlling the drive amount inputted to the drive gear 227.

The embodiments in the image forming apparatus, the sheet conveyance apparatus, and the sheet processing apparatus of the invention are described above. However, the invention is not limited to the above embodiments, but other embodiments, applications, modifications and combinations thereof could be made without departing from the scope and spirit of the invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-251423, filed Aug. 31, 2005, and Japanese Patent Application No. 2006-176452, filed Jun. 27, 2006, which are hereby incorporated by reference herein in their entirety.

What is claimed is:

1. A sheet conveyance apparatus, comprising:

a sheet conveyance unit which conveys a sheet;

a moving unit which moves said sheet conveyance unit in a direction intersecting with a sheet conveyance direction;

a controller which controls a movement of said sheet conveyance unit in the direction intersecting with the sheet conveyance direction; and a pair of conveyance rotary members which is arranged on a downstream side of said sheet conveyance unit in the sheet conveyance direction, said pair of conveyance rotary members being contactable with and being separable from each other, wherein when a moving amount of said sheet conveyance unit in the direction intersecting with the sheet conveyance direction is larger than a predetermined moving amount, said controller controls the movement of said sheet conveyance unit in the direction intersecting with the sheet conveyance direction so that said sheet conveyance unit moves with a moving speed greater than a moving speed for the predetermined moving amount, and wherein when a length of the conveyed sheet in the sheet conveyance direction is longer than a predetermined length, said pair of conveyance rotary members are separated from each other.

2. A sheet conveyance apparatus according to claim 1, wherein said moving unit includes said sheet conveyance unit.

3. A sheet conveyance apparatus according to claim 1, wherein said controller reduces a conveyance speed of said sheet conveyance unit when a length of the conveyed sheet in the sheet conveyance direction is longer than a predetermined length.

4. A sheet conveyance apparatus according to claim 1, wherein said moving unit moves said sheet conveyance unit, while conveying the sheet, in a direction intersecting with a sheet conveyance direction.

5. A sheet conveyance apparatus according to claim 4, wherein when a length of the conveyed sheet in the sheet conveyance direction is the predetermined length, a movement of said sheet conveyance unit by said moving unit is completed before a front end portion of the conveyed sheet reaches said pair of conveyance rotary members.

6. A sheet conveyance apparatus according to claim 1, wherein said controller controls the movement of said sheet conveyance unit in the direction intersecting with the sheet conveyance direction according to the moving amount of said sheet conveyance unit determined by selecting a position of said sheet conveyance unit to be moved by said moving unit in the direction intersecting with the sheet conveyance direction.

* * * * *